US005358121A

United States Patent [19]

Robak et al.

[11] Patent Number: 5,358,121

[45] Date of Patent: Oct. 25, 1994

[54] METHOD AND APPARATUS FOR HEAVY MATERIAL SEPARATION

[75] Inventors: Casimir B. Robak; Virgil P. Butrum, both of Newburg, Ind.

[73] Assignee: Aluminum Company of America, Pittsburgh, Pa.

[21] Appl. No.: 240,080

[22] Filed: May 9, 1994

Related U.S. Application Data

[63] Continuation of Ser. No. 892,531, May 21, 1992, abandoned, and a continuation-in-part of Ser. No. 606,120, Oct. 31, 1990, abandoned.

[51] Int. Cl.[5] ..... B07B 4/00

[52] U.S. Cl. ..... 209/137; 209/154; 209/639

[58] Field of Search ..... 209/34, 35, 136, 137, 209/154, 639

[56] References Cited

U.S. PATENT DOCUMENTS

| | | | |
|---|---|---|---|
| 2,026,910 | 1/1936 | Olsen | 209/137 |
| 2,173,087 | 9/1939 | Eissmann | 209/35 |
| 3,011,634 | 12/1961 | Hutter et al. | 209/74 |
| 3,075,641 | 1/1963 | Hutter et al. | 209/74 |
| 3,216,567 | 11/1965 | Kelly et al. | 209/81 |
| 3,655,043 | 4/1972 | Wochnowski et al. | 209/154 |
| 3,738,483 | 6/1973 | MacKenzie | 209/137 |
| 3,749,240 | 7/1973 | Spears et al. | 209/639 |
| 3,917,567 | 11/1975 | Barret | 209/138 |
| 3,933,626 | 1/1976 | Stukel et al. | 209/134 |
| 4,127,476 | 11/1978 | Iannazzi | 209/3 |
| 4,278,532 | 7/1981 | Birch et al. | 209/19 |
| 4,468,847 | 9/1984 | Bowman et al. | 29/403.3 |
| 4,475,562 | 10/1984 | Thatcher et al. | 131/110 |
| 4,490,247 | 12/1984 | Forsberg et al. | 209/137 |
| 4,491,473 | 1/1985 | Bowman et al. | 75/63 |
| 4,498,523 | 2/1985 | Bowman et al. | 164/477 |
| 4,592,511 | 6/1986 | Bowman | 241/14 |
| 4,737,270 | 4/1988 | Phelps | 209/154 |
| 4,778,061 | 10/1988 | Williams | 290/137 |
| 4,915,824 | 4/1990 | Surtees | 209/137 |

*Primary Examiner*—H. Grant Skaggs
*Assistant Examiner*—Carol L. Druzbick
*Attorney, Agent, or Firm*—Arnold B. Silverman; George K. Stacey

[57] ABSTRACT

A method and apparatus for separating aluminum-based materials from non-aluminum materials is provided. The apparatus includes a conveyor which leads into a chute. Mixed materials which may be pre-shredded travel along the conveyor and into the chute. An adjustable air header assembly is provided at the end of the conveyor within the chute which directs an air stream generally upwardly and at an angle towards the end of the conveyor and the pieces of material thereon. A predetermined air velocity and air flow is selected such that the lighter aluminum materials are lifted and blown, or propelled, a fixed distance as they emerge from the end of the conveyor and the heavier non-aluminum materials fall short of that distance. Suitable collection bins are provided at the appropriate location. The apparatus and associated method used are particularly suited to separating used food and beverage can stock before it enters a recycling station.

10 Claims, 4 Drawing Sheets

METHOD AND APPARATUS FOR HEAVY MATERIAL SEPARATION

CROSS REFERENCE TO RELATED APPLICATION

This Application is a continuation-in-part of U.S. application Ser. No. 606,120, filed Oct. 31, 1990, now abandoned, entitled "METHOD AND APPARATUS FOR HEAVY MATERIAL SEPARATION" and a continuation of U.S. application Ser. No. 892,531, filed on May 21, 1992, now abandoned, entitled "METHOD AND APPARATUS FOR HEAVY MATERIAL SEPARATION".

BACKGROUND OF THE INVENTION

1. Field of the Invention

The present invention relates to an improved separation system for separating aluminum based materials from heavier materials. More particularly, the invention involves use of an air header which separates heavier materials from lighter, aluminum-based materials based upon the weight of the materials.

2. Background Information and Description of the Prior Art

Recycling of waste materials has recently become of the utmost importance in environmental protection measures. The decrease in available landfill space has made recycling the primary solid waste management option. In addition, in the packaging and container fields, such as in the used beverage container field, recycling of and reclaiming aluminum components from used beverage and other food cans is becoming more economically attractive.

Methods for separating various aluminum alloys from materials have been known. For example, methods are provided which can separate alloys used for can ends or lids from a different aluminum alloy used for the body of a can. However, prior to separation of the aluminum alloys in accordance with such methods, it is necessary to separate out non-aluminum components such as lead and other unwanted materials from the used can stream. Magnetic separators have been known and employed for removing magnetic metal, but heretofore nothing has been known for successfully removing non-magnetic materials.

The non-magnetic materials can present a substantial problem. For example, persons who bring used food and beverage aluminum cans to a recycling station are often compensated for doing so based upon the weight of the amount of materials which they submit for recycling. It has become an increasing problem that cans are contaminated with materials such as dirt, lead, sand or other waste products. In addition, some materials have been found to have been placed in used cans by persons who submit the material for recycling in order to provide a greater weight to the overall batch of cans. The items found have included rocks, glass, wood and lead. It has been determined that a substantial percentage of used food and beverage can material is contaminated with these materials because large percentages of non-aluminum substances such as silica and lead have been detected in the material when it is melted in preparation for recycling.

It has been known to provide methods of delacquering and then separating metallic components from used food and beverage cans. For example, U.S. Pat. Nos. 4,468,847 and 4,592,511, both of which are owned by the assignee of the present invention, involve a temperature separation process. This process includes inducing fragmentation of aluminum cans and then separating the fragmented pieces based on the aluminum alloy of each piece. Temperature separation processes are based upon initiation of incipient melting which occurs at different temperature values depending upon different alloys present. Furnaces for accomplishing such temperature-based separation are described in U.S. Pat. Nos. 4,491,473 and 4,498,523 both of which are owned by the assignee of the present invention. As mentioned hereinbefore, however, such systems relate to separation of various aluminum alloys which are contained within food and beverage containers. These disclosures do not relate to separating non-aluminum components from a stream of used food and beverage cans.

Other methods of separating and sorting various materials have been known. For example, U.S. Pat. No. 3,011,634 discloses a method and apparatus for sorting materials such as uranium ore and gold ore. This separation technique is based upon radioactivity detected in the ore. For example, uranium ore will emit a radioactive signal which is detected and a suitable device is then used to remove or separate the uranium ore from the stream. In accordance with one aspect of this disclosure, an air blast can be initiated to remove or separate out the uranium ore from the stream.

Another disclosure relating to sorting pieces of ore in accordance with mineral value is disclosed in U.S. Pat. No. 3,075,641. This patent involves measuring of the size of pieces of ore falling through a detector. The size is determined based upon the effect the moving fragment has when it passes between a stationary light detector and a second detector.

U.S. Pat. No. 3,216,567 discloses a method of sorting rock materials which have different electrical resistances associated with each rock fragment. The property of electrical resistance is utilized for mechanical sorting. A blast of air is used to remove or deflect fragments which do not have the desired set of electrical characteristics.

Other methods have been known for sorting various materials. For example, U.S. Pat. No. 3,917,567 discloses an air classifier for shredded refuse in which the shredded material is sorted on a weight-versus-surface area basis. The disclosure involves a series of ten vertical columns through which the material correspondingly passes and a sorting action takes place in the columns when vertically rising air, being at a lower velocity in each succeeding column, lifts succeedingly lighter portions of the shredded refuse onto the next column while heavier portions rest on the bottom and can be removed.

U.S. Pat. No. 4,127,476 discloses an air classification apparatus for segregating mixed office paper waste. An air source is placed at the bottom of a column which lifts pieces of shredded material upward. Lower pressure air jets are injected at various places through the column to direct medium and light fractions of the shredded material into separate collection hoppers.

U.S. Pat. No. 3,738,483 discloses a method and apparatus for classifying shredded refuse material such as household waste, grass clippings, and the like. The material to be classified is dropped or projected so as to fall into a chamber. Air may be blown into the airborne material as it falls to assist in separating the material into various classifications. With this device and method, the air stream must be sufficient so as to overcome the downward velocity of the falling materials caused by the acceleration of gravity.

A classifier for particulate material is disclosed in U.S. Pat. No. 3,933,626. This classifier involves a stream of particles being introduced into a moving stream of air and the classification is achieved by the varying degrees of entrainment of the particles in the air stream due to their difference in size.

A method and apparatus for separating a tobacco mixture into lighter and heavier fractions is disclosed in U.S. Pat. No. 4,475,562. This disclosure involves a tobacco leaf mixture which contains lighter and heavier fractions being fed into one side of a housing while an air stream flow is introduced at the other side. A suction lift is maintained at the top of the housing to increase the velocity of lighter fractions. Lighter fractions are then siphoned off and these lighter fractions are used as the material from which shredded cigarette tobacco filler is made.

These disclosures do not disclose the separation of aluminum-based materials from heavier scrap metal or non-metallic items from a used food and beverage can stream. There remains a need for a simple, economical and efficient method of separating aluminum components from non-aluminum components in the used beverage can stream. This need exists with particular importance with respect to non-magnetic materials which cannot be separated by known magnetic separation techniques.

SUMMARY OF THE INVENTION

The present invention has met the above-described needs by providing an economical method of separating non-aluminum materials from an incoming stream of used beverage and food cans. The invention provides a chute which is located in a recycling station between a source of mixed materials and a separate aluminum melting station. A vibrating conveyor transports shredded material such as cans to the chute. The end of the conveyor protrudes into the chute such that shredded pieces of material are transported into the chute. An adjustable air header means is provided adjacent to and below the vibrating conveyor which directs an air stream upwardly and at an angle towards the end of the conveyor. Aluminum, being a lighter material, will be lifted off the end of the conveyor as it emerges therefrom and propelled a fixed distance by the air stream. The air stream will keep the aluminum from dropping off of the end of the conveyor. The heavier non-aluminum materials will fall off of the end of the conveyor and will not be propelled by the air stream. A suitable collection bin for the heavier scrap materials is placed directly beneath the end of the conveyor belt. A collection bin for the aluminum-based materials is placed a sufficient fixed distance such that aluminum materials will travel over a gate and fall into the receptacle.

The air header has a suitable intake supply fan which is variable so that the air flow into the air header will be at the appropriate rate. The air header also has an adjustable nozzle which can be restricted to vary air velocity. The air velocity and air flow are adjusted to assure that the greatest percentage possible of aluminum is propelled across the fixed distance. As noted, the materials which are non-aluminum will be heavy enough to fall short of that fixed distance. These materials can then be removed from the material stream. The air header assembly is adjustable so that different weight classes of used can stock can be separated using a single system.

It is an object of the present invention to provide a heavy material separation system which is capable of efficiently separating aluminum from non-aluminum components.

It is another object of the invention to provide a heavy material separation system in a food and beverage can stream or from other materials to be recycled.

It is another object of the present invention to provide such a system which is economical and easy to retrofit with existing separation stations.

It is yet a further object of the invention to provide a separation system which is readily adjustable to accommodate various weight classes of materials to be separated.

It is still another object of this invention to provide a material separation system which uses air to classify the materials, but in which the materials do not fall into the air stream in order to be classified, thereby not requiring the air stream to overcome the downward velocity of falling materials caused by the acceleration of gravity.

These and other objects of the invention will be fully understood from the following description of the invention with reference to the illustrations appended hereto.

DESCRIPTION OF THE PREFERRED EMBODIMENTS

For convenience of disclosure, the present invention is described with reference to a recycling station for used food and beverage cans. However, the invention may be easily employed in the separation of aluminum from non-aluminum materials in other applications as well. Additionally, the invention has application in other circumstances in which a lighter metal or other material is being separated from heavier components. The separation will perform properly as long as there is a weight differential between the two materials and if the heavier material is of a weight greater than about 0.5 ounces.

Figures 1, 2:
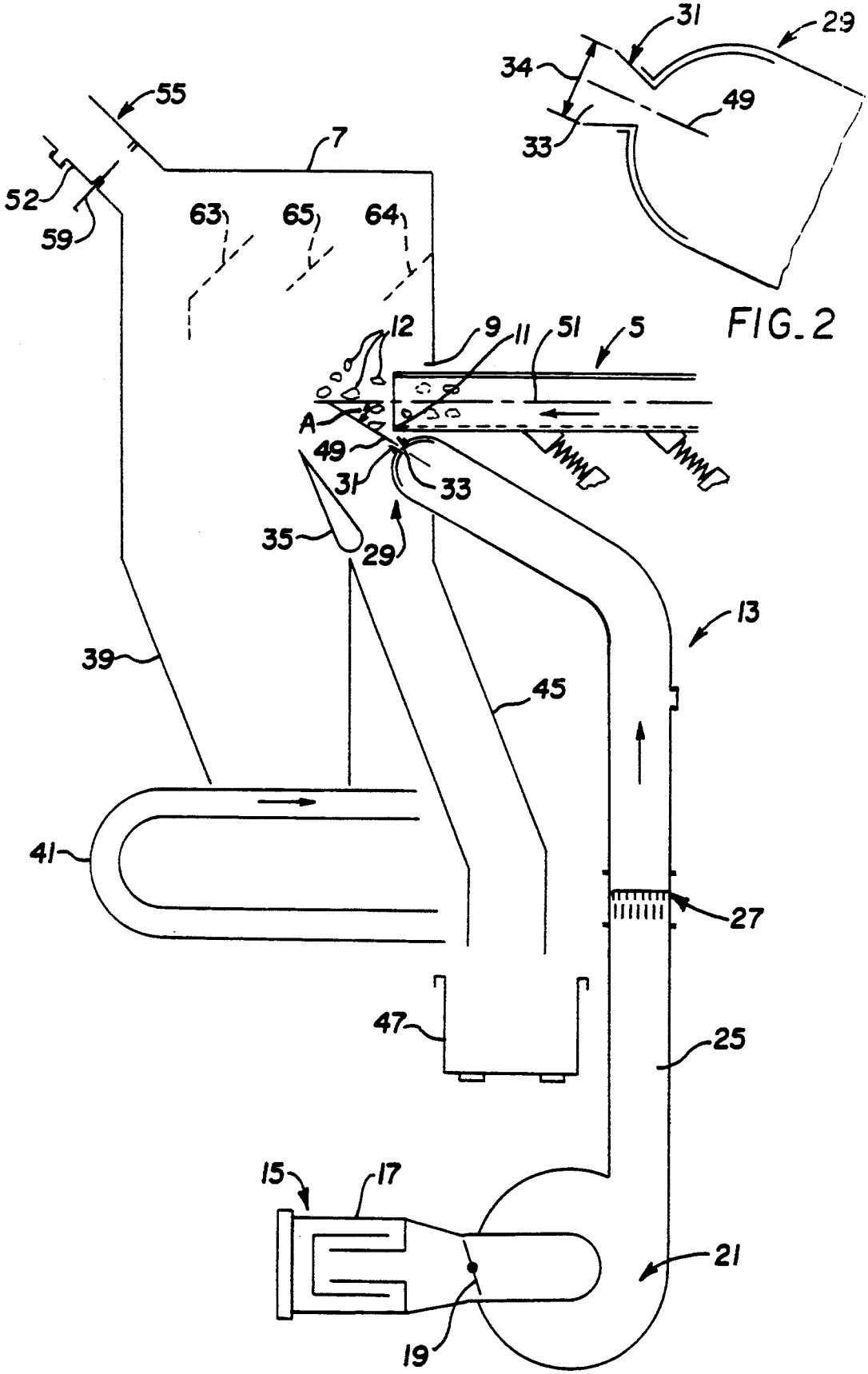
FIG. 1 is a schematic illustration of a separation system of the present invention.
FIG. 2 is an enlarged section of the outlet area and nozzle of the system of FIG. 1.

Referring now to FIG. 1, a schematic illustration of the method and apparatus of the present invention is shown. A vibrating feed conveyor 5 carries a stream of pre-shredded used food and beverage containers towards the separation station. As noted hereinbefore, used food and beverage aluminum containers are pre-shredded by a conventional shredder as would be understood by those skilled in the art. Preferably, the used food and beverage stream is shredded so that pieces of material are between about 0.25 to 2.0 square inches in surface area. Optimum results are achieved if the shredded pieces are of a generally uniform size. However, the method and apparatus may be used with crushed can stock even if it is not shredded to the size noted.

In accordance with the invention an air current, which is discussed more fully below, may be selected to separate the materials primarily based upon weight differential. The stream of materials on conveyor 5 is preferably between about 1.0 and 3.0 inches deep. Conveyor 5 is preferably about 4.5 to 5.5 feet wide. As noted, the device and method of the present invention typically would not be used to separate items all of which are less than about 0.5 ounces in weight.

Chute 7 is provided for receiving the flow of shredded used food and beverage can material. Vibrating conveyor 5 has one end 11 which protrudes into a suitable opening 9 in chute 7 as shown schematically in FIG. 1. Pieces of shredded material 12 are transported into chute 7 on conveyor 5.

An adjustable air supply assembly 13 is provided adjacent to end 11 of vibrating conveyor 5. Air supply assembly 13 is comprised of supply inlet 15 which may have an inlet silencer 17 and a manual damper 19. Air supply assembly 13 also has a supply fan 21, which is preferably, a Cincinnati Fan, Series RBE, Size 15 which is available from Lathrop-Tratter Co. of Indianapolis, Ind. The fan 21 should be capable of adjusting inlet air flow. In accordance with the present invention, the supply air flow rate should range from between about 2,200 feet$^3$/minute to 7,100 feet$^3$/minute. A typical rate would be about 4,720 feet$^3$/minute. Air drawn into the air assembly 13 from intake 15 proceeds through an air flow manifold which is generally designated by reference character 25. Preferably, air flow monitoring station 27 is placed along manifold 25. Air flow monitoring station 21 may be a Brandt model B-DSK-1 available from Brandt Instruments of Fuquay, N.C. This allows air flow to be monitored and then controlled by adjusting the rotational speed of supply fan 21. The air stream then proceeds to outlet area 29 of air header assembly 13.

Referring to FIG. 2, an enlarged view of outlet area 29 is shown. Outlet area 29 has nozzle 31 with an opening 33. The opening dimension designated by reference character 34 is adjustable. Preferably, the dimension 34 of opening 33 can be varied from preferably about 1.5 inches to about 2.5 inches. Typically, this dimension 34 would be open to preferably about 2 inches, however this is one of the variables which is used to adjust the system depending upon the materials to be separated. Depending upon the dimension 34 of opening of 33, the velocity of the air flowing through opening 33 can be varied. Typically, slot velocity will vary between about 1,400 feet per minute and 13,100 feet per minute. It is preferred to operate the air header assembly 13 at a velocity of about 4,400 feet per minute. The velocity is another variable which may be adjusted in order to achieve the most efficient separation of the aluminum from the contaminating items.

Referring to FIGS. 1 and 2, as the pieces of shredded material reach end 11 of vibrating conveyor 5 and emerge therefrom, the lighter, aluminum-based, pieces of material are lifted from the end 11 of conveyor 5 by the air streaming out of slot 33. The air expelled from slot 33 also propels the aluminum-based pieces of material and carries them a sufficient distance such that they proceed over gate 35 and thereafter fall into aluminum can chute 39 (FIG. 1). The aluminum-based material may then be taken by a suitable device such as conveyor belt 41 to a delacquering station (not shown) and to a melting station to ultimately be recycled into fresh aluminum can sheet.

The materials which are not aluminum-based are heavier than the aluminum-based can scrap. Thus, these materials are not lifted or propelled by the air stream coming out of opening 33 in nozzle 31. More specifically, the weight of those components is such that the gravitational forces overcome the upward force of the air and the non-aluminum components thereby fall into scrap chute 45, and they are thereafter discarded.

Extremely fine particles are collected by a dust collection assembly which is described in further detail hereinbelow.

It is important to note that the material is not dropped into the air stream. The air stream coming out of nozzle 31 impinges upon end 11 of conveyor 5. The lighter, aluminum-based pieces are not dropped into chute 7 upon reaching end 11, but rather are immediately lifted and propelled by the air stream as they emerge from end 11, as discussed hereinbefore. The heavier scrap material is allowed to drop into chute 7 and then into scrap chute 45 for collection. As a result, the air stream does not have to overcome the effects of gravity on falling pieces of material. Directing the air stream onto the materials as they emerge from the conveyor results in a system which achieves more efficient separation of materials than is typically achieved with a system in which the materials are dropped into the air stream.

In order to maintain adequate air velocity and air flow rate at end 11 of conveyor 5, it is necessary that nozzle 31 be positioned at or immediately adjacent to end 11. In a preferred embodiment, nozzle 31 is positioned about ¼ to ½ inch below end 11 and about ¼ to ½ inch behind end 11. It will be appreciated, however, that those distances may be varied as necessary in order to improve separation efficiency.

The angle at which the air stream strikes the material is also important. It is preferred to place the air header nozzle 31 such that the angle A between a central axis 49 extending from nozzle 31 (FIG. 1) and a central axis 51 extending along vibrating conveyor 5 would be between about 40 degrees and 70 degrees, and preferably is about 60 degrees. This position allows the air stream to proceed upwards and at an angle towards the shredded pieces of material 12 emerging from end 11 of conveyor 5.

Figure 3:
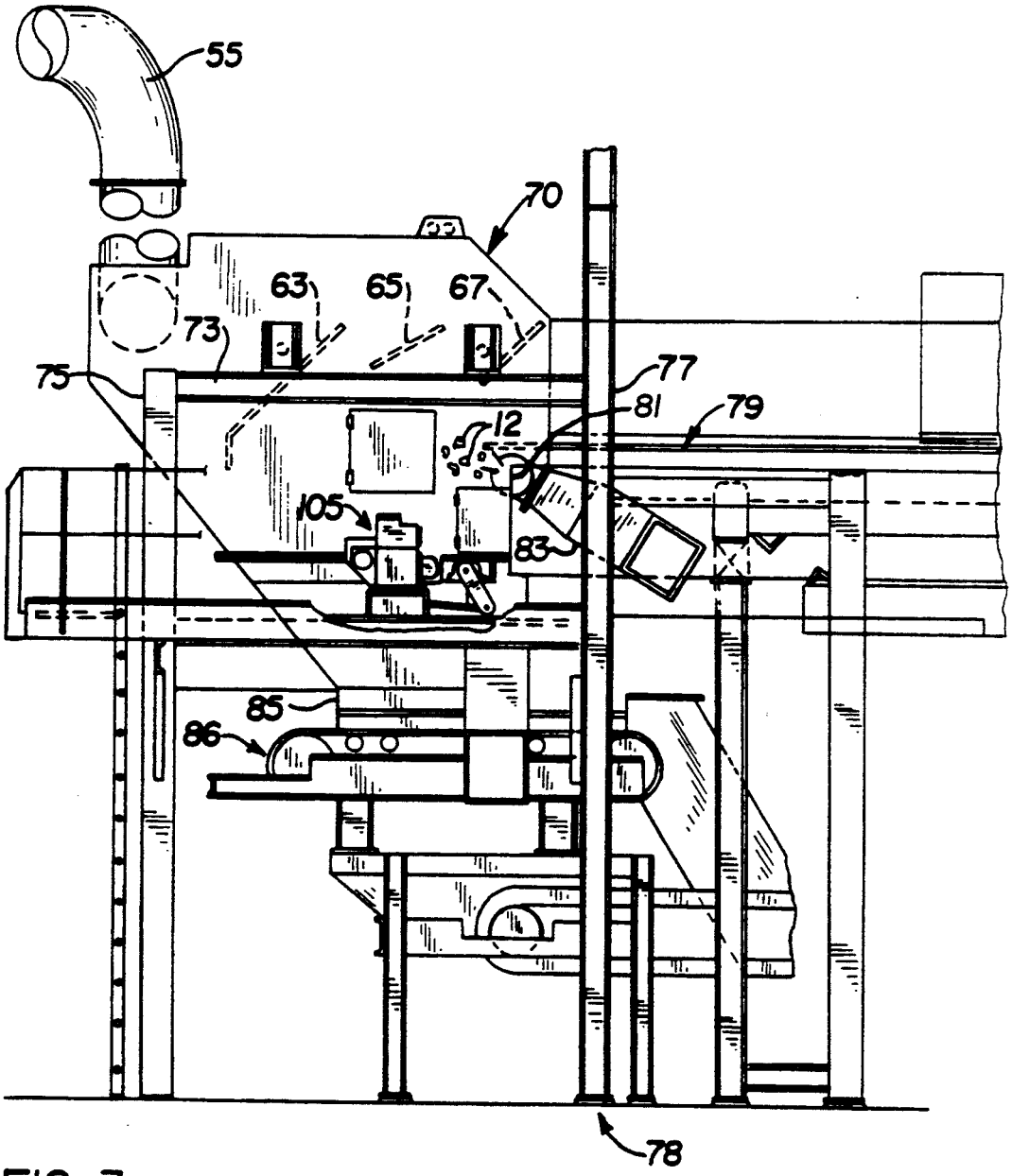
FIG. 3 is a side elevation of a chute and an air header as well as a dust collection duct of the present invention.
Figure 4:
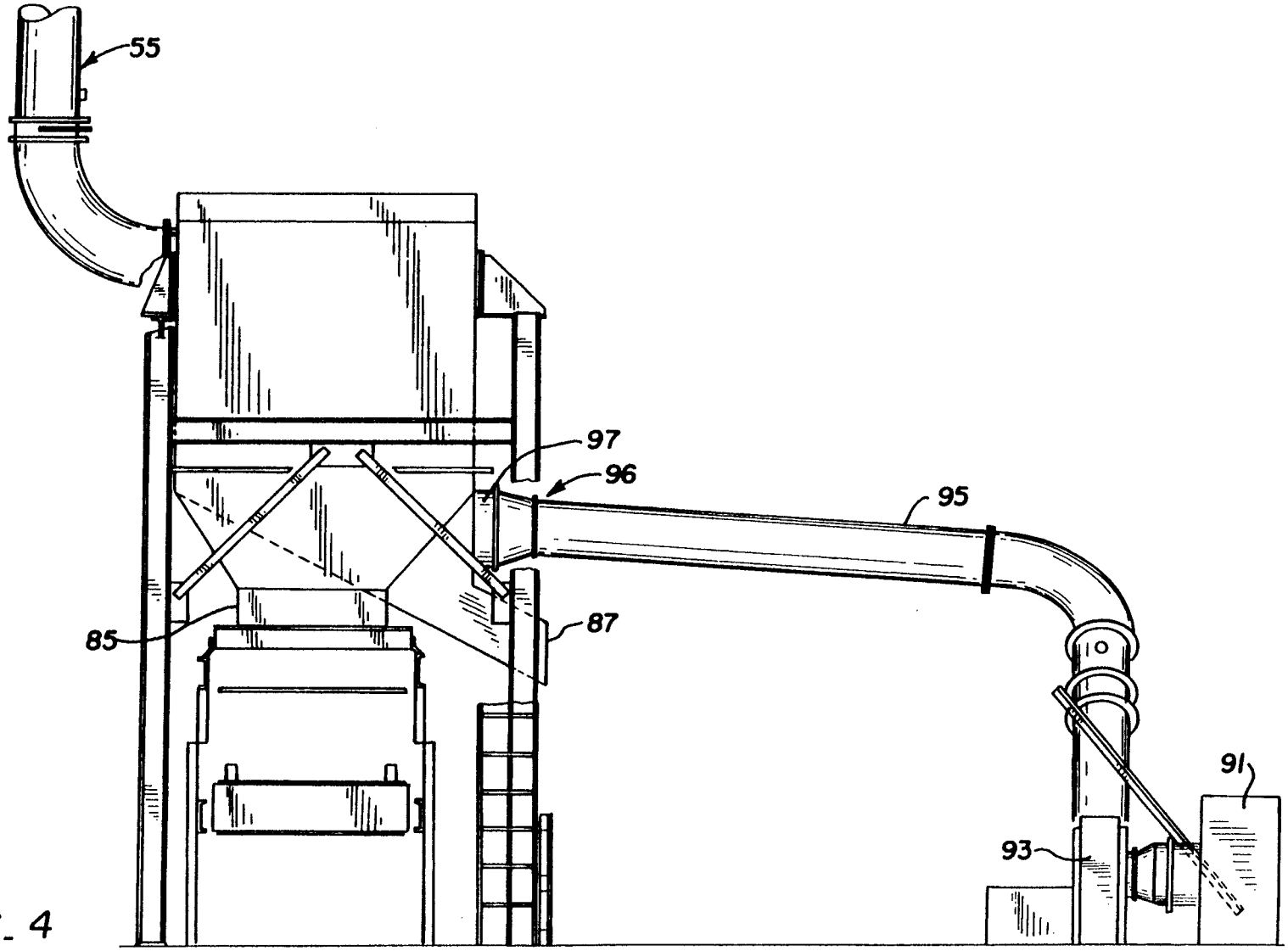
FIG. 4 is a side elevation of the chute and air header manifold of FIG. 3.
Figure 5:
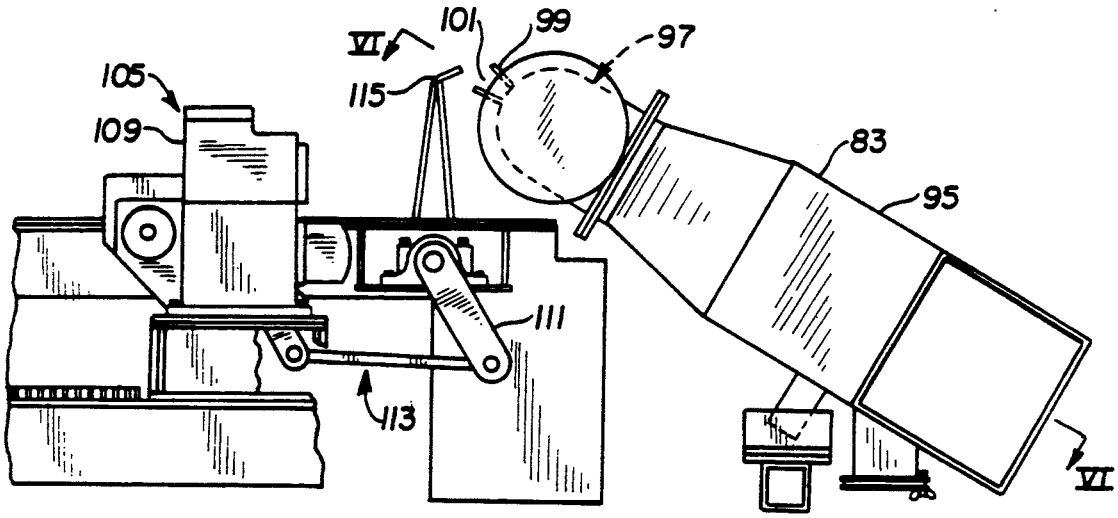
FIG. 5 is an enlarged view of the air header assembly of FIG. 3.

Referring now to FIGS. 3 through 5, the chute and air header are described in greater detail. Chute 70 is preferably about 11 feet high and at its widest area is preferably about 80 square feet in cross-section. Chute 70 is supported by four up standing beams two of which are beams 75 and 77 which are visible in FIG. 3. The beams 75 and 77 are preferably about ten feet high. The upstanding beams are framed by cross-bars such as cross-bar 73 of FIG. 3. A suitable underlying support structure generally designated 88 is also provided. Towards the lower portion of chute 70 which faces the incoming vibrating conveyor 79 is opening 81 for vibrating conveyor 79. Conveyor 79 carries a stream of shredded material in which each piece is between about 0.25 to 2.0 square inches in surface area. The material in the stream is between about 1.0 and 3.0 inches deep. Conveyor 79 is preferably about 4.5 to 5.5 feet wide. Opening 81 is sufficiently wide to allow access for vibrating conveyor 79 as well as air header assembly 83 to enter chute 70. An aluminum scrap opening 85 leads directly out of chute 70 and into a suitable collection bin and conveyor means generally designated with reference character 86.

The scrap chute 87 for the non-aluminum materials is shown more particularly in FIG. 4. Scrap chute 87 is placed such that it leads away from aluminum opening 85 so that the scrap can be conveniently retrieved and discarded or removed from the system.

The air header duct assembly is shown in another view in FIG. 4. Air supply means 91 has an inlet having a filter and a silencer as discussed with reference to FIG. 1. Supply fan 93 accelerates the air which comes through the inlet in supply means 91. The air accelerated by fan 93 proceeds through duct work 95 and into air header 96 having outlet area 97.

An enlarged view of air header assembly 83 is shown in FIG. 5. The duct 95 leads from air intake supply means 91 (FIG. 3). Thereafter, the air proceeds through to outlet area 97 to nozzle 99. As noted hereinbefore, the nozzle 99 has an adjustable opening which, preferably, may be adjusted from about a 1.50 inch opening to about a 2.50 inch opening. An air stream through opening 101 proceeds into chute 70 (FIG. 3) and is directed such that it impinges upon the end of conveyor 79 as discussed hereinbefore. This air stream is used to separate the aluminum-based components, or pieces, from the remainder of the shredded material in the manner hereinbefore discussed.

To further provide that the aluminum-based components are efficiently separated from the remainder of the material, a flop gate assembly 105 is provided (FIG. 5). Flop gate assembly 105 is controlled by actuator 109. The actuator 109 is preferably a Beck actuator which may be obtained from Harold Beck & Sons of Newtown, Pa. As would be understood by one skilled in the art, the actuator has an opened and a closed position and it is controlled by a programmable logic controller (not shown).

The actuator assembly 105 controls flop gate 115 through an actuator arm 111 which is mounted in a slot and pin arrangement assembly generally designated 113 (FIG. 5). If different weight classes are being separated, the position of the gate may be adjusted accordingly.

Flop gate 115 is angled towards the air stream which flows out of opening 101 of air header assembly 83. (FIG. 5). Gate 115 assures that the non-aluminum scrap material does not proceed into the aluminum chute 39 (FIG. 1) and that aluminum-based components which may proceed directly upward would not fall back down into area 118 which leads to the scrap bin 87 (FIG. 4). The aluminum-based components will travel over gate 115 and into the appropriate aluminum receptacle 47 (FIG. 4). Gate 115 is placed at an optimum distance from the end of conveyor 79. This distance is preferably between about 12 to 14 inches. This distance is chosen such that the largest percentage of aluminum-based components are blown across the fixed distance with a very small percentage of undesired non-aluminum scrap material travelling such distance. As noted, the gate position may be varied depending upon the weight classes being sorted.

EXAMPLE

The gap between the end of conveyor 79 and gate 115 was set for about 14 inches and the slot dimension 34 of nozzle 31 was set to about 2.0 inches. The air flow rate through duct 95 was about 8,000 feet$^3$/minute and the air velocity was about 6764 feet/minute. With these parameters, 0.39 percent of the aluminum-based components was recovered with 88.9 percent of non-aluminum materials. In other words, all aluminum was separated except the 0.39 percent which was mixed with the non-aluminum-based components after separation. In addition, 88.9 percent of the non-aluminum components was recovered.

Figure 6:
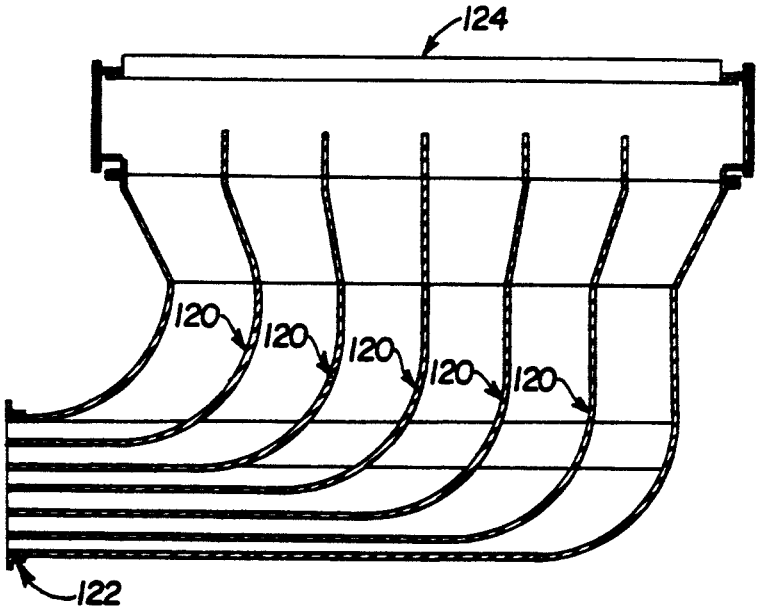
FIG. 6 is a cross-section of a set of turning vanes for the air header taken along line VI—VI of FIG. 5.

With reference to FIG. 6, the air header internal assembly is shown in greater detail. Air enters area 122 from manifold 25 (FIG. 1). The air is then separated and directed by turning vanes 120 so that an even distribution of air is obtained across nozzle opening 124. It is preferred to provide for an even distribution of air across nozzle opening 124 to achieve a uniform distribution of air across the width of vibrating conveyor 5 (FIG. 1). This assists in obtaining uniform and optimum separation across the entire material stream.

As mentioned hereinbefore, it also preferred to provide a dust collection assembly to remove fine particles and dust from the chute 7. The dust collection assembly system 55 (FIG. 1) includes a port and duct system 57 which is connected to an air withdrawal system (not shown) which would be understood by those skilled in the art and which could be, for example, a fan. A slide gate damper 59 is also provided to adjust the opening from which the dust collection will occur. The dust collection assembly acts to remove very fine particles from the system and this avoids the need of having to remove such fine particles in a prior step in the separation process. In order to reduce the likelihood that any stray airborne pieces of aluminum will be caught in the dust collection assembly 55, deflector plates such as plates 63, 65 and 67 are provided to deflect such aluminum-based pieces which are entrained in the air stream downwards so that such pieces are not taken up by the dust collection system.

It is preferred that the air flow rate of the dust collection system would be between about 4,700 feet$^3$/minute and 9,600 feet$^3$/minute. The air flow velocity is preferably between about 2,000 feet per minute and 5,000 feet per minute.

With reference to all of the Figures, the operation of the present invention will be discussed. Used beverage and food cans which are crushed, or preferably, shredded enter the system on a vibrating conveyor 5 (FIG. 1). The particles 12 proceed along vibrating conveyor 5 to end 11 which protrudes into chute 7 (FIG. 1). The air header assembly 13 provides an air stream at a predetermined, desired angle, air flow and velocity. The air stream impinges upon end 11 of conveyor 5. The particles 12 travel to end 11 of conveyor 5. As the particles 12 emerge from end 11 the air stream lifts the aluminum-based components off of end 11 and propels them a sufficient distance so that they travel across gate 115. (FIG. 5). After travelling this distance, aluminum particles fall into aluminum can chute 39 (FIG. 1) and into an appropriate collection bin. Heavier components are not affected by the air stream and they fall directly from end 11 through scrap chute 45 into an appropriate scrap bin 47 (FIG. 1). Because the air stream does not separate the particles as they fall, it does not have to overcome the downward velocity resulting from the acceleration of gravity on such falling particles.

In accordance with the method of the present invention, a stack of materials to be separated is placed upon a vibrator conveyor 5. The method includes transporting the materials to the end 11 of a conveyor 5 which is disposed within a chute 7. The materials may be shredded food and beverage aluminum cans. The method further includes providing an air stream directed generally upwardly at an angle toward the end 11 of conveyor 5, and selecting the air flow rate and air velocity such that the forces of the air stream will initially overcome the gravitational forces of the weight of the pieces of a first component of the materials as they emerge from the end 11 of conveyor 5, thereby lifting such pieces off of end 11 and propelling them a predetermined fixed distance. The first component may be aluminum, in which case the air flow rate and velocity will be chosen such that a piece of aluminum material of a particular size will "float", or be blown by, the air stream across a fixed distance. The method further includes providing a collection device 41 for collecting the materials which are blown across the fixed distance. Pieces of a second component of the materials, which are heavier than the pieces of the first component, are preferably not lifted or propelled at all by the air stream, or are lifted and propelled a shorter distance than the pieces of the first component, and may be collected as they fall off of end 11 of conveyor 5.

It should be understood that the present invention provides an economical and efficient means of separating non-aluminum components from aluminum-based components of used materials which are being recycled. The method and apparatus of the present invention can be easily retrofitted to an existing separation system in which aluminum can sheet is prepared from used cans by delacquering and melting. The present invention provides a very effective method and apparatus for separating materials based upon weight. The apparatus is adjustable to accommodate separation of different weight classes of stock.

Whereas particular embodiments of the invention have been described hereinabove for purposes of illustration, it will be evident to those skilled in the art that numerous variations of the details may be made without departing from the invention as defined in the appended claims.

What is claimed is:

1. A method of separating non-aluminum materials from aluminum materials in an incoming stream of shredded used food and beverage cans, including the steps of:

providing a conveyor leading into and having one end in a chute, and an air header means for generating an air stream at a predetermined velocity and air flow;

moving said shredded cans to said end of said conveyor;

directing said air stream generally upwardly and at an angle towards said end of said conveyor;

selecting a predetermined air flow and air velocity of said air stream to lift said aluminum materials from said end of said conveyor as they emerge from said end of said conveyor, before they are permitted to fall, and propel them a predetermined distance from said end of said conveyor; and collecting the aluminum materials in an aluminum bin which is placed said predetermined distance from said conveyor.

2. The method of claim 1 including selecting said predetermined air flow to be between about 7,000 feet$^3$/minute and 2,200 feet$^3$/minute.

3. The method of claim 1 including selecting said predetermined air velocity to be between about 1,400 feet/minute and 13,000 feet/minute.

4. The method of claim 1 including selecting as said predetermined distance, a distance of between about 12 and 14 inches.

5. The method of claim 1 including collecting the non-aluminum materials in a scrap bin after they have traveled a distance from said end of said conveyor which is shorter than said predetermined distance.

6. A method of separating non-aluminum materials from aluminum materials in a stream of shredded aluminum cans which includes pieces of aluminum cans and some materials which are denser than aluminum, comprising:

conveying a stream of shredded aluminum cans mechanically along a substantially horizontal path having a terminal end at which said stream is no longer mechanically supported;

directing an air stream at said terminal end at a predetermined velocity and air flow, said air stream being directed at an upward angle with respect to said substantially horizontal path;

moving said stream of shredded cans off said terminal end so that the denser materials are permitted to fall off said terminal end and said pieces of aluminum cans are propelled by said air stream a predetermined distance from said terminal end before they are permitted to fall therefrom; and collecting said pieces of aluminum can separately from said denser materials.

7. The method of claim 6 including selecting said predetermined air flow to be between about 7,000 feet$^3$/minute and 2,200 feet$^3$/minute.

8. The method of claim 6 including selecting said predetermined air velocity to be between about 1,400 feet/minute and 13,000 feet/minute.

9. The method of claim 6 including selecting as said predetermined distance, a distance of between about 12 and 14 inches.

10. The method of claim 6 including collecting the denser materials in a scrap bin after they have travelled a horizontal distance from said end of said conveyor which is shorter than said predetermined distance.

* * * * *